US008926298B2

(12) United States Patent
Rajput et al.

(10) Patent No.: US 8,926,298 B2
(45) Date of Patent: Jan. 6, 2015

(54) HYDRAULIC PISTON PUMP WITH A VARIABLE DISPLACEMENT THROTTLE MECHANISM

(75) Inventors: Prashant K. Rajput, Pune (IN); Dwight Stephenson, Oconomowoc, WI (US)

(73) Assignee: HUSCO International, Inc., Waukesha, WI (US)

( * ) Notice: Subject to any disclaimer, the term of this patent is extended or adjusted under 35 U.S.C. 154(b) by 559 days.

(21) Appl. No.: 13/343,436

(22) Filed: Jan. 4, 2012

(65) Prior Publication Data

US 2013/0167957 A1 Jul. 4, 2013

(51) Int. Cl.

| | |
|---|---|
| ***F04B 1/06*** | (2006.01) |
| ***F04B 49/03*** | (2006.01) |
| ***F04B 53/10*** | (2006.01) |

(52) U.S. Cl.

USPC ..... 417/532; 91/498

(58) Field of Classification Search

USPC ..... 417/516, 531, 532; 91/498

See application file for complete search history.

(56) References Cited

U.S. PATENT DOCUMENTS

| | | | | |
|---|---|---|---|---|
| 3,151,569 | A | 10/1964 | Muller | |
| 3,418,937 | A | 12/1968 | Cardillo et al. | |
| 3,434,428 | A * | 3/1969 | Liles | 417/270 |
| 4,065,229 | A * | 12/1977 | Black | 417/270 |
| 5,634,777 | A | 6/1997 | Albertin | |
| 5,701,873 | A | 12/1997 | Schneider | |
| 5,810,569 | A | 9/1998 | Buckley et al. | |
| 6,213,729 | B1 * | 4/2001 | Fassbender et al. | 417/273 |
| 2004/0101417 | A1 | 5/2004 | Arai et al. | |

FOREIGN PATENT DOCUMENTS

| | | |
|---|---|---|
| JP | 09-228943 | 9/1997 |

* cited by examiner

*Primary Examiner* — Bryan Lettman

(74) *Attorney, Agent, or Firm* — Quarles & Brady LLP

(57) ABSTRACT

A radial piston pump has a plurality of cylinders within which pistons reciprocally move. Each cylinder is connected to a first port by an inlet passage that has an inlet check valve, and is connected to a second port by an outlet passage that has an outlet check valve. A throttling plate extends across the inlet passages and has a separate aperture associated with each inlet passage. Rotation of the throttling plate varies the degree of alignment of each aperture with the associated inlet passage, thereby forming variable orifices for altering displacement of the pump. Uniquely shaped apertures specifically affect the rate at which the variable orifices close with throttle plate movement, so that the closure rate decreases with increased closure of the variable orifices.

26 Claims, 5 Drawing Sheets

HYDRAULIC PISTON PUMP WITH A VARIABLE DISPLACEMENT THROTTLE MECHANISM

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to hydraulic pumps, such as those that have pistons that move radially against an eccentric shaft, and more particularly to mechanisms for controlling the flow of fluid through the cylinders in which the pistons move.

2. Description of the Related Art

A common type of radial piston pump comprises a body with a plurality of cylinders radially disposed around a drive shaft that is rotated by an external motor or engine. A separate piston is slideably received within each cylinder, thereby defining a chamber at the interior of the cylinder. The drive shaft has an eccentric cam and the pistons are biased by springs to ride against that cam. As the cam rotates, the pistons slide reciprocally within the respective cylinders, thereby reducing and expanding the volume of the cylinder chambers in a cyclical manner. The smallest volume occurs at the top dead center point of the piston cycle and the largest volume occurs at the bottom dead center point.

An inlet port supplies fluid to an inlet passage that has a separate inlet into each cylinder. Every cylinder also has an outlet that is coupled by a separate outlet check valve to an outlet passage that leads to the outlet port of the pump. U.S. Pat. No. 3,434,428 discloses a pump of this configuration. The pump in that patent also has a throttle plate with apertures associated with the inlets for the cylinders. The throttle plate is rotated by an actuator to vary alignment of the apertures with the inlets and thereby alter the amount of fluid flowing between the common inlet passage and each cylinder inlet.

With this type of pump, as the piston moves from the top dead center point, fluid is not initially drawn into the expanding cylinder chamber because the location of the piston blocks the inlet. The piston has to move a considerable distance from the top dead center point before the inlet is unblocked and fluid from the inlet passage is drawn into the expanding cylinder chamber. After the bottom dead center point, the volume of the cylinder chamber begins reducing, however, the inlet still is open which prevents outlet check valve from opening. Here too, the piston must move some distance before the piston blocks the inlet and causes pressure in the cylinder chamber to increase. As the piston starts to pump, the sealing land of the piston is low in the cylinder and high pressure fluid leakage occurs thereby making this form of aspiration initially in-efficient. Eventually the pressure rises to a level that forces the outlet valve to open an outlet path through which the fluid is exhausted from the cylinder chamber. That exhausting continues until the piston again reaches the top dead center point.

A drawback of this type of pump is that during a dead portion of the piston cycle, between bottom dead center point and when the inlet becomes closed, no pumping action occurs. Specifically, fluid is neither being expelled from the cylinder nor being drawn into the cylinder during that dead portion, which can be a third of the piston cycle as shown in FIG. 6 of the U.S. Pat. No. 3,434,428. This inactive time and initial short sealing length results in a sizeable inefficiency. In addition this type of pump requires a relatively long piston stroke to accommodate the dead portion of the piston cycle, which increases the diameter of the pump.

These prior radial piston pumps also had a relatively large diameter due to the outlet valves and the outlet passage being located radially outward from each cylinder. For many machines, the amount of space for the pump is limited, thus it is desirable to reduce the size of the pump. More specifically, many times the pump is mounted alongside an engine or transmission and the radial space is limited preventing the installation of typical radial piston pumps.

SUMMARY OF THE INVENTION

A pump includes a cylinder block with an inlet port, an outlet port, a plurality of cylinders disposed radially in the cylinder block. A plurality of inlet passages are each connected between the inlet port and a different one of the plurality of cylinders, and a plurality of outlet passages each connected between the outlet port and a different one of the plurality of cylinders. A separate piston is slideably located in a each of the plurality of cylinders and drive shaft is rotatably received in the cylinder block for driving the piston reciprocally the cylinders.

A separate inlet check valve is located in each of the plurality of inlet passages and allows fluid flow only in a direction from the inlet port into one of the plurality of cylinders. A separate outlet check valve is located in each of the plurality of outlet passages and allow fluid flow only in a direction from one of the plurality of cylinders into the outlet port.

A throttle plate communicates with each of the plurality of inlet passages for varying a rate of fluid flow through the inlet passages. In one embodiment, the throttle plate extends across each of the plurality of inlet passages and has a plurality of control apertures there through. The throttle plate is moveable to alter alignment of the control apertures with the inlet passages and thereby vary a cross sectional area through which fluid flows in the inlet passages. This provides a variable orifice in each inlet passage.

One aspect of the present pump is that the flow area of the variable orifice is directly related to the magnitude of the fluid flow there through. Broadly speaking, as the throttle plate is moved from a position corresponding with the variable orifice being fully open to a position with the variable orifice is fully closed, the average rate of change of the flow area of the variable orifice relative to movement of the throttle plate is greater during a first half of the travel distance between the fully open and fully closed positions. For example, the flow area of the variable orifice decreases at least 80 percent in the first half of the throttle plate travel distance from the fully open position. This rapid closure rate of the variable orifice occurs in what is referred to as the first section of the throttle plate rotation. Thereafter, the rate of change of the flow area decreases significantly slower, requiring that the throttle plate move through the second half of travel distance to reduce the flow area the remaining 20 percent.

DETAILED DESCRIPTION OF THE INVENTION

Figure 1:
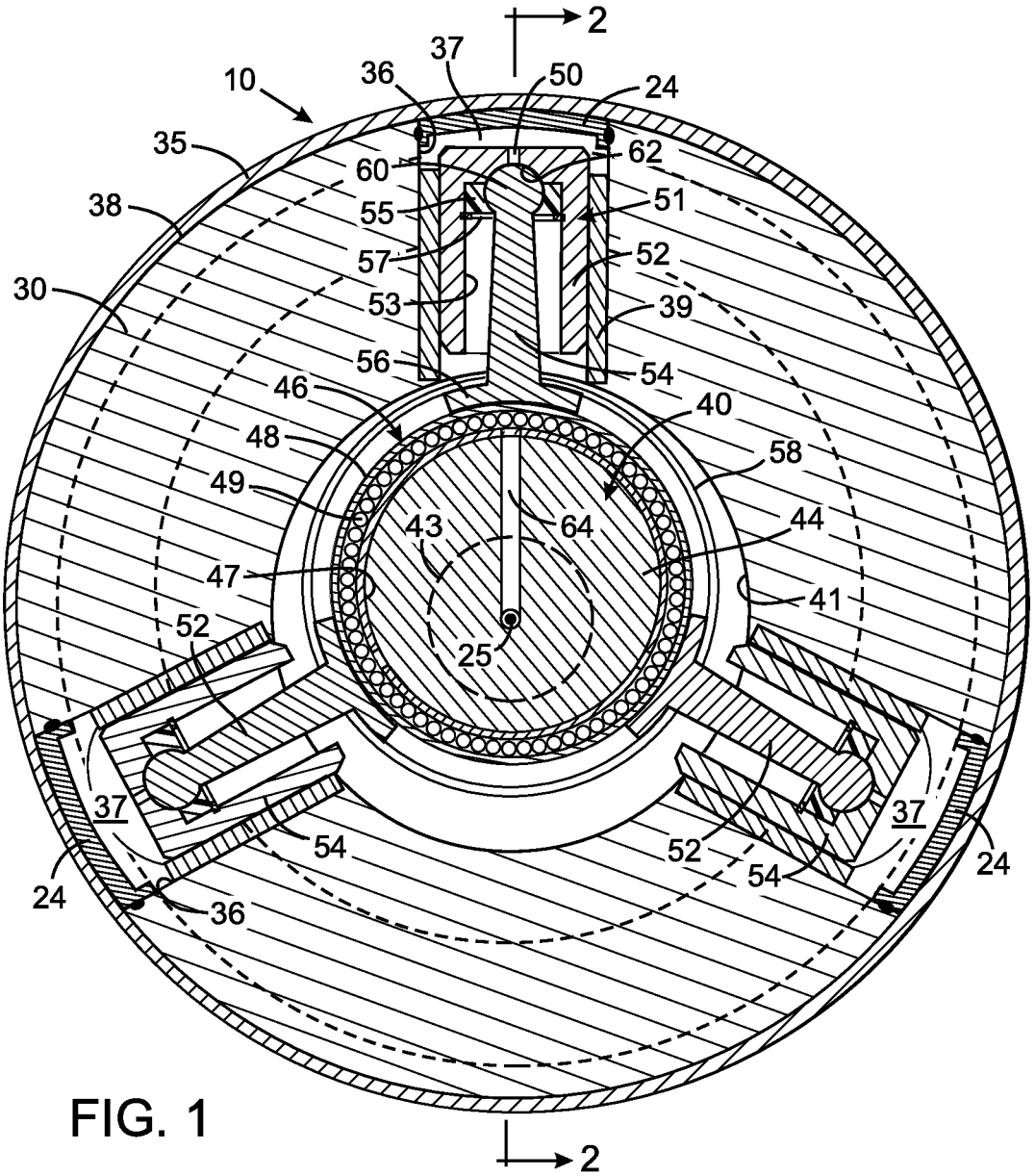
FIG. 1 is a radial cross section showing the arrangement of the cylinders and pistons in the pump.

The term "directly connected" as used herein means that the associated components are connected together by a conduit without any intervening element, such as a valve, an orifice or other device, which restricts or controls the flow of fluid beyond the inherent restriction of any conduit. References herein to directional relationships and movement, such as top and bottom or left and right, refer to the relationship and movement of the components in the orientation illustrated in the drawings, which may not be the orientation of the components as attached to machinery.

Figure 2:
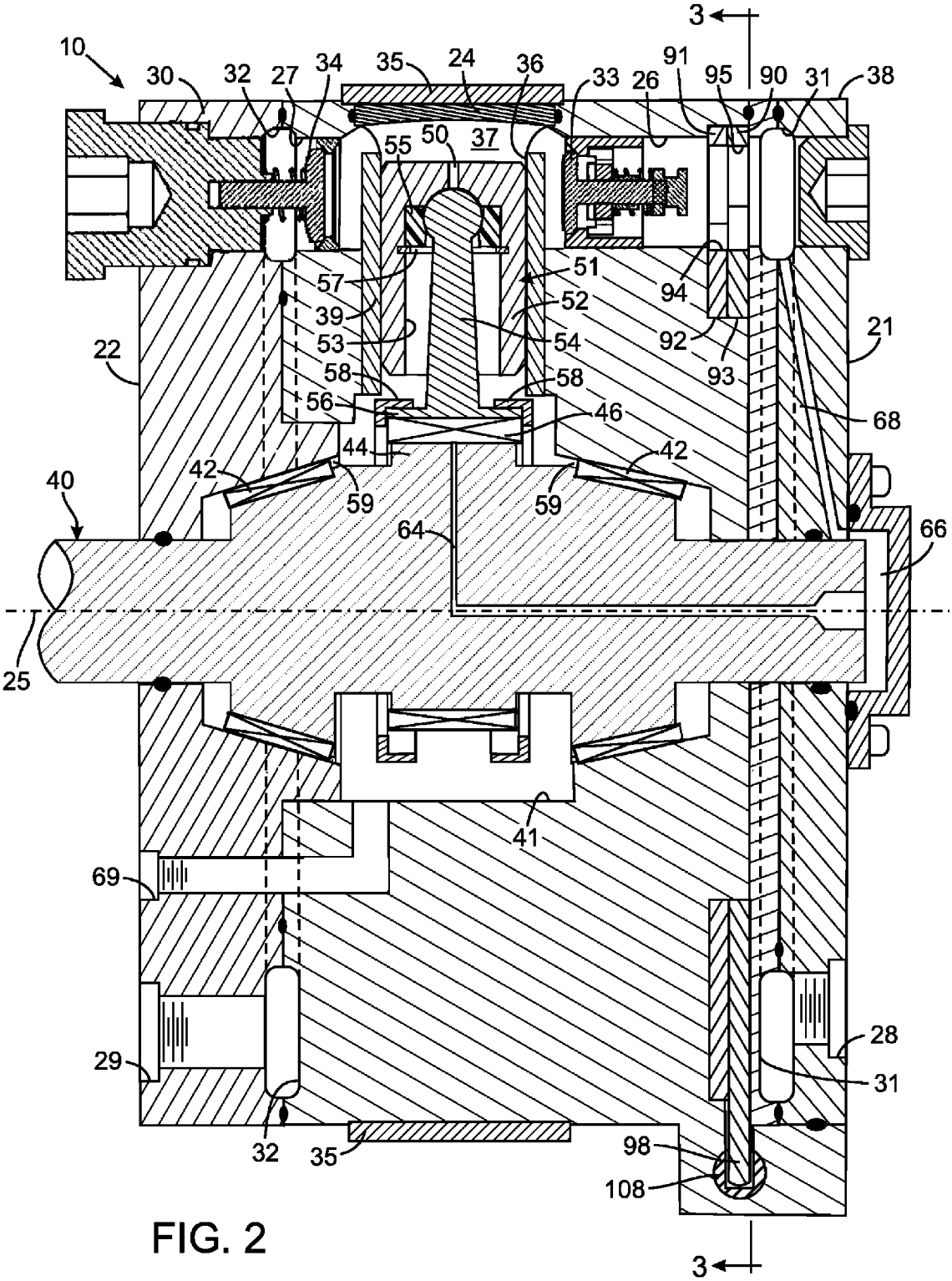
FIG. 2 is an axial cross section through the radial piston pump along line 2-2 in FIG. 2.

With reference to FIGS. 1 and 2, a hydraulic pump 10 has a cylinder block 30 with exterior first and second end surfaces 21 and 22 between which a cylindrical exterior side surface 38 extends. The cylinder block 30 has an inlet port 28 and an outlet port 29 through which hydraulic fluid is received and expelled from a hydraulic system. The inlet and outlet ports 28 and 29 open into inlet and outlet galleries 31 and 32, respectively, that extend in circles through the cylinder block around a central shaft bore 41 in the cylinder block 30. Three cylinders 36 extend radially outward from and are oriented at 120 degree increments around the central shaft bore 41. Although the exemplary pump 10 is illustrated with three cylinders to simplify the drawings, in practice the pump may have a greater number of cylinders (e.g., 6 or 8 cylinders) to reduce torque, flow and pressure ripples at the outlet. Each cylinder 36 comprises a tubular sleeve 39 that is inserted into a bore in the cylinder block 30. Although the sleeve 39 is beneficial in reducing the diameter of the pump 10 as will be described, the sleeve can be eliminated by using a material for the cylinder block that can be machined to form the cylinder bores. Each cylinder 36 has an opening through the cylindrical side surface 38 of the cylinder block 30. A sealing cup 24 with an O-ring is placed inside each opening and a continuous band-shaped closing ring 35 extends around the side surface 38 tightly closing each of the cylinder openings. The closing ring 35 eliminates the relatively long plugs that projected outward from the cylinders in conventional pump designs and thereby reduces the overall diameter of the pump 10.

With particular reference to FIG. 2, a plurality of inlet passages 26 are formed by first bores that extend into the first end surface 21 of the cylinder block 30 and each inlet passage opens into both the inlet gallery 31 and a respective one of the cylinders 36. In other words, each inlet passage 26 is directly connected to both the inlet gallery 31 and one of the cylinders 36. A separate inlet check valve 33 is located in each of those inlet passages 26. The inlet check valve 33 opens when the pressure within the inlet passage 26 is greater than the pressure within the associated cylinder chamber 37, as occurs during the intake phase of the pumping cycle. A plurality of outlet passages 27 are formed by second bores that extend into the second end surface 22 of the cylinder block 30 with each outlet passage opening into both the outlet gallery 32 and a respective one of the cylinders 36. Every outlet passage 27 is directly connected to both the outlet gallery 32 and one of the cylinders 36. A separate outlet check valve 34 is located in each of those outlet passages 27. The outlet check valve 34 opens when pressure within the associated cylinder chamber 37 is greater than the pressure within the outlet gallery 32, as occurs during the exhaust phase of the pumping cycle. It should be understood that the inlet and outlet galleries 31 and 32 communicate with all the piston cylinders in the pump and an identical pair of check valves is provided for each cylinder. Each of the inlet and outlet check valves 33 and 34 is passive, meaning that it operates in response to pressure exerted thereon and not by an actuator, such as an electric solenoid.

The tubular sleeve 39 that partially forms the cylinder 36 enables the inlet and outlet check valves 33 and 34 to be placed closer to the longitudinal axis 25 of the drive shaft 40. Note that the inlet and outlet check valves 33 and 34 are within the closed curved perimeter defined by the exterior side surface 38 of the cylinder block 30. In prior configurations the valves had to be outward from the top dead center position of the piston in order to receive the fluid forced out of the cylinder chamber 37. As shown in FIG. 2, the tubular sleeve 39 extends partially over the opening between the cylinder chamber 37 and the bores in which the check valves 33 and 34 are located, thereby extending the cylinder bore farther into the cylinder chamber 37.

Referring again to both to FIGS. 1 and 2, a drive shaft 40 extends through the shaft bore 41 and is rotatable therein being supported by a pair of bearings 42. The center section of the drive shaft 40 within the cylinder block 30 has an eccentric cam 44. The cam 44 has a circular outer surface, the center of which is offset from longitudinal axis 25 of the drive shaft 40. As a consequence, as the drive shaft 40 rotates within the cylinder block 30, the cam 44 rotates in an eccentric manner about the axis 25 of the drive shaft. As specifically shown in FIG. 2, a cam bearing 46 has an inner race 47 that is pressed onto the outer circumferential surface of the cam 44 and an outer race 48. A plurality of rollers 49 are located between the inner race 47 and an outer race 48 of the cam bearing. With the proper heat treatment and surface finishing, the surface of the cam 44 can serve as the inner bearing race. The cam bearing 46 improves the efficiency of the pump 10 over previous pumps that used a sliding journal bearing for this function. The rollers may be cylindrical, spherical, or other shapes.

A separate piston assembly 51 is slideably received within each of the cylinders 36. Every piston assembly 51 comprises a piston 52 and a piston rod 54. The piston rod 54 extends between the piston 52 and the cam bearing 46. The piston rod 54 has a curved shoe 56 which abuts the outer race 48 of the cam bearing 46. The shoe 56 is wider than the shaft of the piston rod creating a flange portion. A pair of annular retaining rings 58 extend around the cam 44 engaging the flange portion of each piston rod shoe 56, thereby holding the piston rods 54 against the cam bearing 46, which is particularly beneficial during the intake stroke portion of a pumping cycle. The retaining rings 58 eliminate the need for a spring to bias the piston assembly 51 against the cam bearing 46. The curved shoe 56 evenly distributes the piston load over a wide area of the cam bearing 46. As the drive shaft 40 and cam 44 rotate within the cylinder block 30, the outer race 48 of the cam bearing 46 remains relatively stationary. The outer race 48 rotates at a very slow rate in comparison to the speed of the drive shaft and the inner race 47. Therefore, there is little relative motion between each piston shoe 56 and the cam bearing's outer race 48.

The piston 52 is cup-shaped having an interior cavity 53 which opens toward the drive shaft 40. An end of the piston rod 54 is received within that interior cavity 53 and has a partially spherical head 60 that fits into a mating partially spherical depression 62 in the piston 52. The head of the piston 52 may have an aperture 50 there through to convey hydraulic fluid from the cylinder chamber 37 to lubricate the interface between a spherical head 60 and the piston 52. The piston rod 54 is held against the piston 52 by an open single bushing or a split bushing 55 and a snap ring 57 that rests in an interior groove in the piston's interior cavity 53. As the piston rod 54 follows the eccentric motion of the cam 44 and the piston 52 in turn follows by sliding within the cylinder 36. The bushing and snap ring arrangement allows the spherical head 60 of the piston rod to pivot with respect to the piston 52 when a rotational moment is imposed onto the piston rod 54 by rotation of the cam 44. Because of that pivoting, the rotational moment is not transferred into the piston 52, thereby minimizing the lateral force between the piston and the wall of the cylinder 36.

With continuing reference to FIG. 2, the drive shaft 40 includes an internal lubrication passage 64 extending from one end to the outer surface of the cam 44. The lubrication passage 64 has a single opening in that outer surface at the center of the eccentric apex of the cam to feed fluid into the cam bearing 46. The other end of the lubrication passage 64 opens into a chamber 66 at the end of the drive shaft 40 and that chamber receives relatively low pressure fluid through a feeder passage 68 from the inlet gallery 31. As the drive shaft 40 rotates, centrifugal force expels fluid from the lubrication passage 64 into the cam bearing 46. This action draws additional fluid into the lubrication passage 64 from the chamber 66, thereby providing a pumping function for fluid that lubricates the cam bearing 46. If the cam bearing 46 has an inner race 47, that inner race has apertures that convey the lubricating fluid to the rollers 49. The outer race 48 also has through holes to lubricate the shoes 56 of the piston rods 54, thereby providing splash lubrication and eliminating a need to have the central shaft bore 41 filled with fluid. Not having the crankcase filled with fluid reduces windage drag on the eccentric cam 44 and improves efficiency of the pump. Additional lubricating passages 59 are provided to convey fluid from the shaft bore 41 to the bearings 42 for the drive shaft 40. The fluid used for lubrication exits the central shaft bore 41 through a standard drain port 69 from which the fluid is conveyed to a tank for the hydraulic system.

Pumping Operation

Rotation of the eccentric cam 44 causes each piston 52 to move cyclically within the respective cylinder 36, away from the sealing cup 24 during a fluid intake phase and then toward the sealing cup 24 during a fluid exhaust phase. Because of the radial arrangement of the cylinders 36, at any point in time some pistons 52 are in the intake phase while other pistons are in the exhaust phase.

The piston 52 illustrated in FIG. 2 is at the a top dead center position when the volume of its cylinder chamber 37 is the smallest, which occurs at a transition point from the exhaust phase to the intake phase during each piston cycle. From this point, the outlet check valve 34 closes and further rotation of the eccentric cam 44 moves the piston 52 into the intake phase. During the intake phase, the volume of the cylinder chamber 37 increases, thereby initially decompressing the fluid remaining therein which tends to drive or put energy back into the drive shaft 40. Thereafter, further increase in the cylinder volume produces a negative gauge pressure therein. As a result, the inlet check valve 33 is forced open by a positive atmospheric pressure applied from the inlet gallery 31. Thus, fluid flows from the inlet gallery 31 through the inlet passage 26 and the inlet check valve 33 into the expanding cylinder chamber 37. At this time, when a negative pressure in the cylinder chamber 37, the pressure in the outlet gallery 32 is positive due to either the flow output of the other cylinder chambers passing through a restriction or a static or dynamic load on the output. That pressure differential forces the outlet check valve 34 closed against its valve seat. The intake phase continues until the eccentric cam 44 moves that piston 52 to the bottom dead center position, at which the volume of cylinder chamber 37 is the greatest. Thus the bottom dead center position occurs at a transition in the piston cycle from the intake phase to the exhaust phase.

Thereafter, further rotation of the eccentric cam 44 moves the piston 52 into the exhaust phase during which the piston moves outward, away from the center axis 25. That motion initially compresses the fluid in the cylinder chamber 37, thereby increasing the pressure of that fluid. Soon the pressure in the cylinder chamber 37 is approximately that same as the pressure in the inlet passage 26, at which point the associated spring closes the inlet first check valve 33. Eventually, the cylinder chamber pressure exceeds the pressure in the outlet gallery 32 and forces the outlet check valve 34 open, releasing the fluid from the cylinder chamber 37 into the outlet gallery and to the outlet port 29.

When continued rotation of the eccentric cam 44 moves the piston 52 to the top dead center position shown in FIG. 2, the exhaust phase is complete and thereafter the piston transitions into the intake phase of another pumping cycle.

Because the inlet and outlet check valves 33 and 34 open and close almost immediately at the top dead center and bottom dead center positions, essentially the entire piston cycle is use to draw fluid into the cylinder chamber and then expel that fluid. This is in contrast to prior pumps that had throttle plates, but relied on the position of the piston to open and close an inlet opening into the cylinder. Those prior pumps had a dead region, which is some cases was one third the piston cycle, during which fluid was neither being drawn into or expelled from the cylinder chamber. Thus with the present pump configuration an equivalent fluid volume can be pumped by each piston cycle with less piston stroke distance. This feature contributes to the compact size of the present pump.

Throttle Plate Operation

Figure 3:
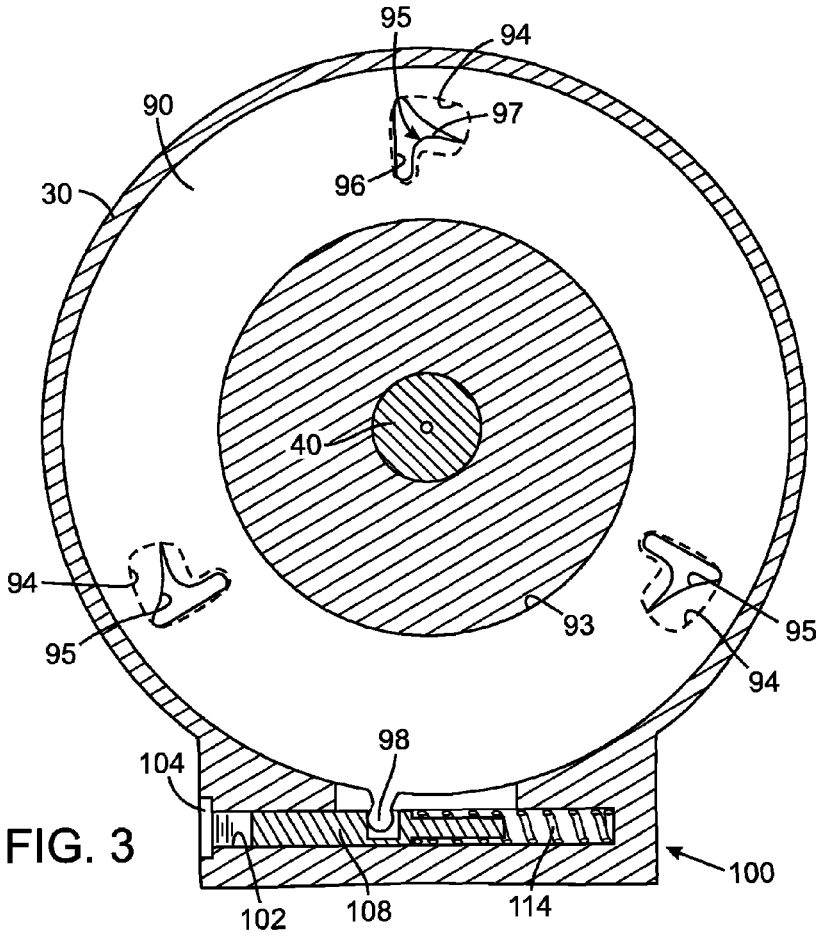
FIG. 3 is an radial cross section through the radial piston pump along line 3-3 in FIG. 2 showing a position of a throttle plate in which apertures therein are in fully open states.

With reference to FIGS. 2 and 3, the hydraulic pump 10 includes a throttle mechanism that varies the inlet opening area from the shared inlet gallery 31 into the inlet passage 26 and through the inlet check valve 33 for each cylinder 36 during the intake phase. That throttle mechanism comprises a circular throttle plate 90 and an abutting transition plate 91 that are sandwiched between two sections of the cylinder block 30 so as to extend across each of the plurality of inlet passages 26. The throttle plate 90 and the transition plate 91 have central apertures 92 and 93, respectively through which the drive shaft 40 extends. The transition plate 91 is held stationary within the cylinder block 30 and has a plurality of transmission apertures 94, each fixedly aligned with one of the inlet passages 26. The throttle plate 90 is rotatable around the drive shaft 40 and has a plurality of control apertures 95 proximate to the transmission apertures 94 in the transition plate 91. The control apertures 95 of the throttle plate 90 and the transmission apertures 94 in the transition plate 91 are formed on nearly the same radius as that of the inlet passages 26, thus assuring registration of those apertures with the inlet passages upon rotation of the throttle plate through a predefined arc. As will be described, rotation of the throttle plate aligns and misaligns the control apertures 95 with the transmission apertures 94, thereby creating variable orifices that control the fluid flow between the inlet gallery 31 and the cylinders 36.

The hydraulic pump 10 further includes an actuator 100 for rotating the throttle plate 90 within the cylinder block 30. For that purpose, a tab 98 projects outward from the outer edge of the throttle plate 90 and into an actuator bore 102 in the cylinder block 30. The actuator bore 102 has a control port 104 to which a hydraulic conduit from a control circuit connects. An actuator piston 108 is slideably received in the actuator bore 102 and engages the tab 98 of the throttle plate 90. Pressurized fluid applied to the control port 104 drives the piston to the right in the actuator bore 102 (see FIG. 3), thereby causing the throttle plate to rotate into different positions such as those shown in FIGS. 4 and 5.

Figure 7:
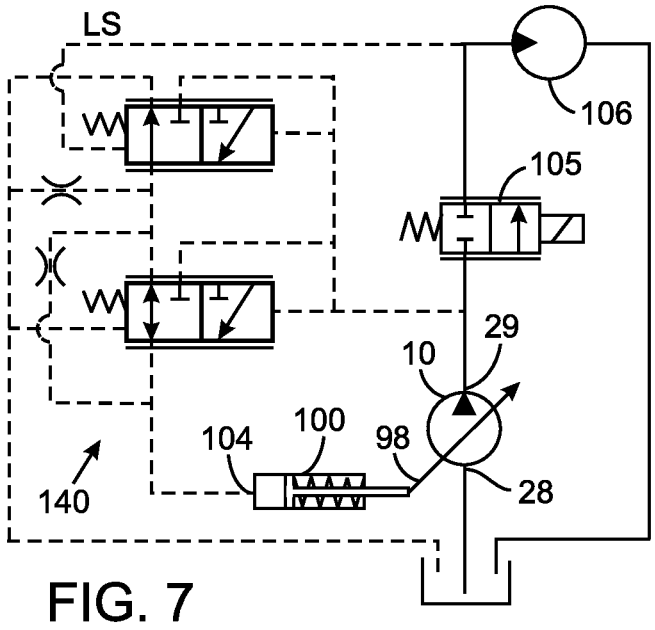
FIG. 7 is schematic diagram of a hydraulic circuit for controlling the position of the throttle plate.

FIG. 7 depicts one type of a hydraulic circuit 140 that controls the displacement of the pump 10 by rotating the throttle plate 90 to maintain a desired pressure at the outlet port 29 of the pump. The pump outlet port 29 is connected to a conventional control valve 105 that controls the operation of a hydraulic actuator 106, such as a motor or a piston/cylinder actuator of a machine with which the pump 10 is used. The hydraulic circuit 140 responds to a standard load senses pressure signal LS, received from the hydraulic actuator 106, by maintaining the displacement of the pump 10 to produce a desired output pressure for operating the hydraulic actuator. Other hydraulic circuits can be used to operate the throttle plate actuator 100.

The angular position of the throttle plate 90 within the cylinder block 30 determines the alignment of the control apertures 95 in the throttle plate with the transmission apertures 94 in the transition plate 91. Varying that alignment alters the degree to which those apertures overlap and thus alters the cross sectional area through which fluid is able to flow between the inlet gallery 31 and the cylinders 36 during the piston cycle intake phase. In other words, the adjustable alignment of the transmission and control apertures 94 and 95 forms a variable orifice in that flow path provided by the inlet passages 26. Both the control apertures 95 and the transmission apertures 94 have unique shapes so that fluid flow varies in a specific manner to regulate the displacement of the pump 10 and maintain the output pressure at a desired level. FIG. 3 illustrates the control apertures 95 and the transmission apertures 94 in a fully aligned orientation that provides the maximum flow between the inlet gallery 31 and cylinders 36. As the throttle plate 90 rotates counter clockwise and the transmission and control apertures 94 and 95 become misaligned to greater degrees, the area of that variable orifice initially changes at a relatively high rate until reaching the position depicted in FIG. 4. As the orifice area thereafter becomes smaller, the rate that the area changes decreases, i.e. the area changes more slowly for identical increments of change in the angular position of the throttle plate.

The variation in the rate of orifice area change is determined by the unique shape of the transverse cross section of the control apertures 95 in the throttle plate 90. Transverse cross section as used herein means a cross section across a control aperture in a plane that is transverse to the direction that fluid flows through the aperture. As shown in FIG. 3, each control aperture 95 has a transverse cross sectional shape that has an oval primary region 96 from which a tapered region 97 projects, like a beak of a bird, and terminates at an apex. The primary region 96 has a relatively large cross sectional area as compared to the cross sectional area of the tapered region 97. The control apertures 95 can have other shapes and still attain variation of the rate of change of the fluid flow, as described herein. Each transmission aperture 94 in the transition plate 91 has a size and shape which ensures that the entire cross sectional area of the associated control aperture 95 communicates with the inlet passage 26 when the throttle plate 90 in the fully aligned position. That full alignment of the transmission and control apertures 94 and 95 enables the entire area of the control aperture 95 to conduct fluid through the throttle plate 90 and thus provides the maximum flow of fluid from the inlet gallery 31 into each cylinder 36 during the intake phase of the piston cycle. A spring 114 biases the actuator piston 108 into a position in which the throttle plate 90 is in the fully aligned aperture position.

From the fully aligned position in FIG. 3, application of pressurized fluid to the control port 104 drives the actuator piston 108 which acts on the tab 98 rotating the throttle plate 90 counter clockwise. Continued motion eventually moves the throttle plate 90 into an intermediate position depicted in FIG. 4. As the throttle plate 90 moved between those positions the larger primary regions 96 of the control apertures 95 move over the edge of the transmission apertures 94 in the transition plate 91, thereby closing off some of the area of each control aperture. Because of the large size of the oval primary regions 96, the area through which fluid flows through the orifice, created by the control apertures 95 and the transmission apertures 94, diminishes at a relatively fast rate (see FIG. 8). That is for a given incremental distance that the actuator piston 108 moves and thus for a given incremental angular change in throttle plate position, an relatively large change in flow occurs.

Figure 4:
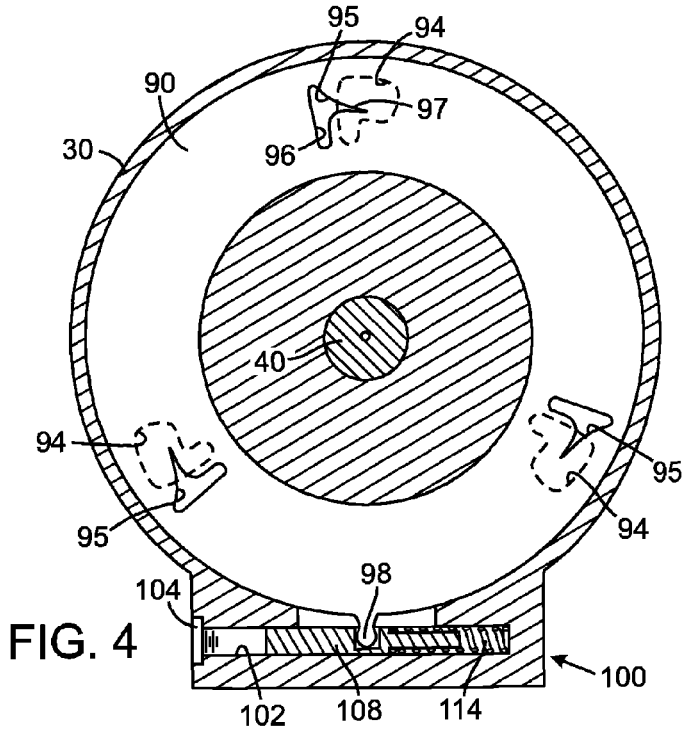
FIG. 4 illustrates another position of a throttle plate in which the apertures are in partially open states.

Upon reaching the intermediate position in FIG. 4, only the tapered regions 97 of the control apertures 95 remain aligned to communicate with the transmission apertures 94 in the transition plate 91. Thus fluid can only flow through the throttle plate 90 via those tapered sections. In this intermediate position, the control apertures 95 are only partially aligned with the transmission apertures 94 in the transition plate 91. Depending upon the amount of overlap in this intermediate position, the amount of flow between the inlet gallery 31 and each of the inlet passages 26 is reduced from the fully aligned position.

The amount of this flow can be proportionally controlled by controlling the rotational position of the throttle plate 90 and thus the amount of that aperture overlap. As the rotation of the throttle plate 90 continues the tapered aperture regions 97 cause the flow area to change at a smaller rate than occurred during previous motion to reach that intermediate position from the fully aligned position of the transmission and control apertures 94 and 95. Now for each given incremental distance that the actuator piston 108 moves and for each given incremental angle change of the throttle plate, an relatively smaller change in flow area occurs than happened previously. Therefore, the rate that the open area of the control apertures 95 changes decreases as that open area becomes smaller.

Figure 5:
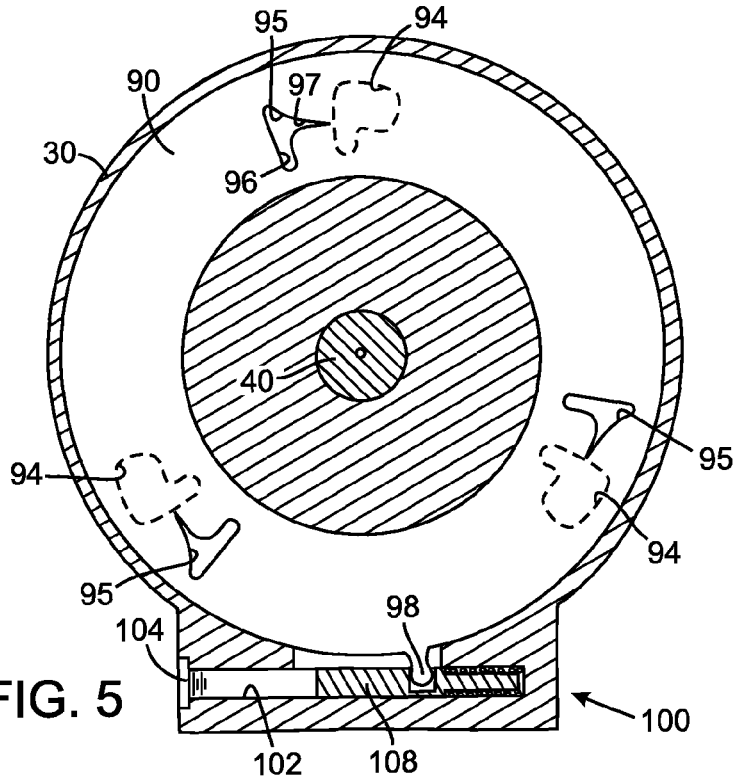
FIG. 5 shows a further position of a throttle plate in which the apertures are closed.

Continued activation of the control actuator 100, results in the throttle plate 90 eventually reaching the position illustrated in FIG. 5 in which the control apertures 95 are entirely misaligned with the transmission apertures 94 in the transition plate 91. That is, no part of the throttle plate control apertures 95 overlaps or opens into the transition plate transmission apertures 94 and fluid flow between the inlet gallery 31 and the cylinders 36 is blocked.

Figure 6:
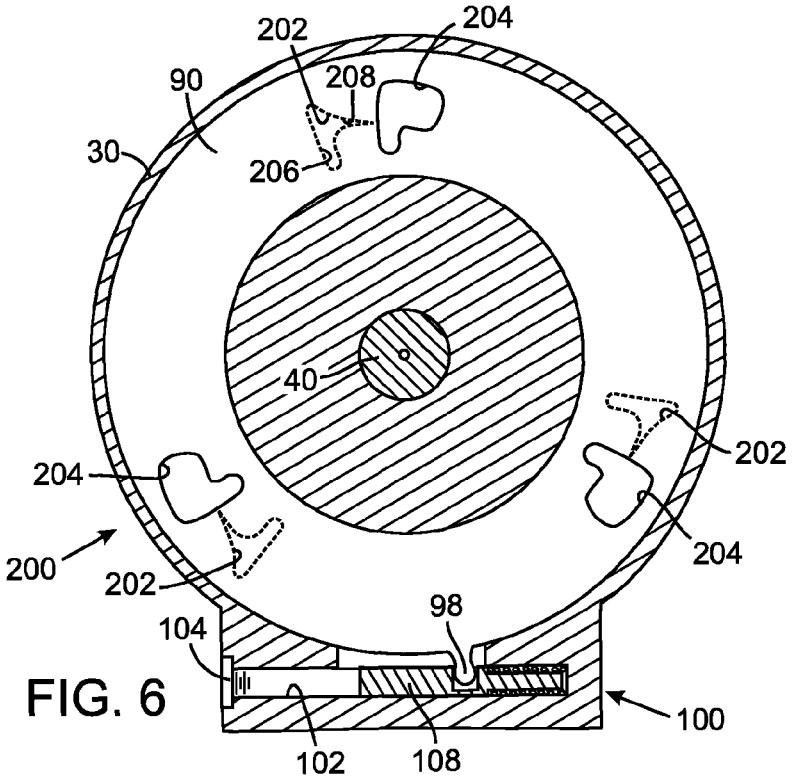
FIG. 6 is an radial cross section through the radial piston pump similar to FIG. 5, but showing an alternative arrangement of the apertures in the throttle plate.

FIG. 6, illustrates an second hydraulic pump 200 that is similar to the first hydraulic pump 10 as shown in FIG. 5 in which similar components have been assigned identical reference numerals. The distinction between the first and second hydraulic pumps is that the transmission apertures 202 in the transition plate 91 of the second hydraulic pump 200 have an oval primary section 206 from which a tapered section 208 projects, like a beak of a bird, and terminates at an apex. The control apertures 204 in the throttle plate 90 are identical to the transmission apertures 94 in the transition plate 91 of the first hydraulic pump 10. In other words, the shapes of the transmission and the control apertures are switched in the second hydraulic pump 200. Nevertheless, the transmission apertures 202 and the control apertures 204 function in the same manner, as described with respect to the first hydraulic pump 10, regarding creating variable orifices that control the fluid flow between the inlet gallery and the cylinders of the pump.

Figure 8:
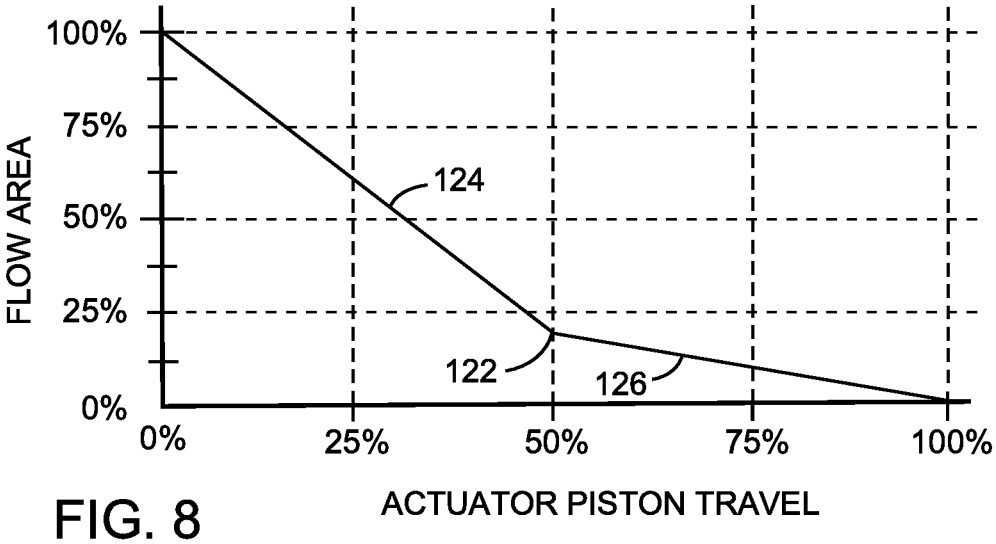
FIG. 8 is a graph of the relationship of the size of the open area of the apertures versus the position of the throttle plate.

FIG. 8 graphically illustrates the relationship of the size of the open area, or flow area, of the control apertures 95 versus the position of the throttle plate 90, which is related to the linear position of the actuator piston 108 for the exemplary pump. The flow area of the orifice is directly related to the magnitude of the fluid flow there through. The actuator piston and the throttle plate move from a first position, corresponding with the orifice being fully (100 percent) open, to a second position, corresponding with the orifice being fully closed (0 percent open). A mid position is located halfway between the first and second positions, i.e., at 50 percent of the travel distance between the first and second positions. Broadly speaking, as the throttle plate moves from the first position to the second position, the average rate of change of the flow area of the variable orifice relative to movement of the actuator piston is significantly greater during the first half of travel compared to the second half of travel. For example, the flow area of the variable orifice created by the position of the control aperture 95 relative to the transmission aperture 94 decreases by at least 80 percent in the first 50 percent of the travel of the actuator piston from the initial first position, as depicted a point 122 that occurs at the mid position in FIG. 3. This rapid closure rate of the variable orifice occurs in what is referred to as a first section 124 of the throttle plate rotation.

Thereafter the rate of change of the flow area decreases significantly slower, requiring that the actuator piston 108 move the remaining 50 percent of the travel distance (the second section 126 of the throttle plate rotation) to reduce the flow area the final 20 percent to the fully closed position. Thus during the second section of throttle plate rotation, the piston and the throttle plate decreases the flow from 20 percent of the maximum flow to zero flow over the same amount (i.e., 50 percent) of throttle plate rotation as it takes to decrease the flow from 100 percent to 20 percent of the maximum flow. In other words, at a constant rate of rotation of the throttle plate 90, the flow area of the variable orifice changes from the maximum flow area to about 20 percent of that maximum flow area at a rate that is at least twice as fast and the rate at which the flow area changes between about 20 percent of that maximum flow area and zero flow area. Therefore from the fully aligned aperture position, rotation of the throttle plate initially produces a relatively rapid decrease in flow area and then the flow area decrease occurs at a slower rate the as aperture motion approached the closed position. The inverse rates of change occur as the throttle plate 90 moves clockwise in the drawings and the variable orifice, formed by the degree of alignment of the control apertures 95 with the transmission apertures 94, opens greater amounts.

The use of a throttle plate 90 to control the amount of flow between the inlet gallery 31 and the inlet passages 26 enables the displacement of the pump 10 to be dynamically varied. When the throttle plate apertures 95 are only partially aligned with the transition plate transmission apertures 94, the amount of fluid flowing into the cylinder chamber 37 during the intake phase of each piston cycle is reduced. As a result, the piston 52 reaches bottom dead center without the cylinder chamber 37 being completely filled with hydraulic fluid. Thus, a portion of the total effective piston displacement is lost. The amount of lost displacement does not vary significantly as a function of the speed of the pump, since the average pressure drop across the throttle plate is constant for typical pump speeds of 800 to 2500 RPM.

The present pump configuration with the rotatable throttle plate 90 provides variable throttle choking at the input of each inlet check valve. This has a significant advantage over a pump that has throttle choking at a single place for all the cylinders, such as between the inlet port 28 and the inlet gallery 31. With the per inlet check valve choking arrangement of the present pump 10, the fluid volume between the throttle plate and the inlet check valve is relatively small and results in improved consistency and dynamic response in both starting and stopping fluid flow.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

The invention claimed is:

1. A pump comprising:

a cylinder block with an inlet port, an outlet port, a plurality of cylinders disposed in the cylinder block, a plurality of inlet passages each connected between the inlet port and a different one of the plurality of cylinders, and a plurality of outlet passages each connected between the outlet port and a different one of the plurality of cylinders;

a plurality of pistons each slideably received in a different one of the plurality of cylinders;

a drive shaft rotatably received in the cylinder block for driving the plurality of pistons within the plurality of cylinders; and a throttle member extending across the plurality of inlet passages and having a plurality of control apertures there through, wherein each control aperture has a transverse cross sectional shape with a primary region from which a tapered region projects, the throttle member being moveable relative to the cylinder block to alter alignment between the plurality of inlet passages and the plurality of control apertures.

2. The pump as recited in claim 1 wherein each tapered region terminates at an apex.

3. The pump as recited in claim 1 wherein each control aperture forms a variable orifice in each of the plurality of inlet passages, wherein the throttle plate has a first position at which the variable orifice has a maximum size, a second position at which the variable orifice has a minimum size, and a mid position that is halfway between the first position and the second position, and wherein during movement from the first position to the mid position, the size of the variable orifice changes from the maximum size to less than 20% of the maximum size, and during movement between the mid position and the second position, the size of the variable orifice further reduces to the minimum size.

4. The pump as recited in claim 1 further comprising an actuator for moving the throttle member.

5. The pump as recited in claim 1 further comprising a plurality of inlet check valves, each located in one of the plurality of inlet passages and allowing fluid flow from the inlet port into one of the plurality of cylinders and restricting fluid flow from the one of the plurality of cylinders into the inlet port.

6. The pump as recited in claim 1 further comprising a plurality of outlet check valves, each located in one of the plurality of outlet passages and allowing fluid flow only from one of the plurality of cylinders into the outlet port.

7. The pump as recited in claim 1 wherein the cylinder block has an exterior surface in which each of the plurality of cylinders has an opening; and further comprises a closure band engaging the exterior surface and closing the openings of the plurality of cylinders.

8. The pump as recited in claim 1 wherein the cylinder block includes a first end surface and a second end surface between which extends an exterior surface through which each of the plurality of cylinders opens, wherein the plurality of inlet passages open through the first end surface and the plurality of outlet passages open through the second end surface.

9. The pump as recited in claim 1 wherein the plurality of cylinders are disposed radially in the cylinder block.

10. A pump comprising:

a cylinder block with an inlet gallery, an outlet gallery, a plurality of cylinders disposed in the cylinder block, a plurality of inlet passages each communicating with the inlet gallery and a different one of the plurality of cylinders, and a plurality of outlet passages each communicating with the outlet gallery to a different one of the plurality of cylinders;

a plurality of pistons each slideably received in a different one of the plurality of cylinders;

a drive shaft rotatably received in the cylinder block and having a surface for reciprocally driving the plurality of piston assemblies within the plurality of cylinders; and a throttle plate extending across each of the plurality of inlet passages, and having a plurality of control apertures there through and forming a variable orifice in each of the plurality of inlet passages, wherein the throttle plate has a first position at which the variable orifice has a maximum size, a second position at which the variable orifice has a minimum size, and a mid position that is halfway between the first position and the second position, and wherein during movement from the first position to the mid position, the size of the variable orifice changes from the maximum size to less than 20% of the maximum size, and during movement between the mid position and the second position, the size of the variable orifice further reduces to the minimum size.

11. The pump as recited in claim 10 wherein each control aperture has a transverse cross sectional shape with a primary region from which a tapered region projects.

12. The pump as recited in claim 11 wherein each tapered region terminates at an apex.

13. The pump as recited in claim 10 further comprising an actuator for moving the throttle plate.

14. The pump as recited in claim 10 wherein movement of the throttle plate alters a positional relationship of the plurality of control apertures with the plurality of inlet passages to vary flow of fluid.

15. The pump as recited in claim 10 further comprising a plurality of inlet check valves each located in one of the plurality of inlet passages and allowing fluid flow from the inlet gallery into one of the plurality of cylinders and restricting fluid flow from the one of the plurality of cylinders into the inlet gallery.

16. The pump as recited in claim 10 further comprising a plurality of outlet check valves each located in one of the plurality of outlet passages and allowing fluid flow only from one of the plurality of cylinders into the outlet gallery.

17. The pump as recited in claim 10 wherein the throttle plate extends across each of the plurality of inlet passages between the inlet gallery and the plurality of inlet check valves.

18. A pump comprising:

a cylinder block with an inlet port, an outlet port, a plurality of cylinders disposed in the cylinder block, a plurality of inlet passages each connected between the inlet port and a different one of the plurality of cylinders, and a plurality of outlet passages each connected between the outlet port and a different one of the plurality of cylinders;

a plurality of pistons each slideably received in a different one of the plurality of cylinders;

a drive shaft rotatably received in the cylinder block for driving the plurality of pistons within the plurality of cylinders;

a plurality of inlet check valves, each located in one of the plurality of inlet passages and allowing fluid flow from the inlet port into one of the plurality of cylinders and restricting fluid flow from the one of the plurality of cylinders into the inlet port; and a throttle member forming a variable orifice in each of the plurality of inlet passages, wherein, at a constant rate of movement of the throttle member relative to the cylinder block, the variable orifice closes at a rate that decreases as the variable orifice approaches a fully closed position.

19. The pump as recited in claim 18 wherein the throttle member has a first position at which the variable orifice has a maximum size, a second position at which the variable orifice has a minimum size, and a mid position that is halfway between the first position and the second position, and wherein during movement from the first position to the mid position, the size of the variable orifice changes from the maximum size to less than 20% of the maximum size, and during movement between the mid position and the second position, the size of the variable orifice further reduces to the minimum size.

20. The pump as recited in claim 18 wherein each of the plurality of inlet passages is associated with a transmission aperture and the throttle member has a plurality of control apertures each of which communicates with a transmission aperture, the throttle member being moveable to alter alignment between the transmission apertures and the control apertures, thereby forming the variable orifice in each inlet passage.

21. The pump as recited in claim 20 wherein the throttle member is moveable between a first position in which each control aperture is fully aligned with one transmission aperture and a second position in which each control aperture is remote from every transmission aperture.

22. The pump as recited in claim 20 wherein each control aperture has a transverse cross sectional shape with a primary region from which a tapered region projects, wherein each of the primary region and the tapered region extends through the throttle plate.

23. The pump as recited in claim 22 wherein each tapered region terminates at an apex.

24. The pump as recited in claim 20 wherein each transmission aperture is formed in a stationary transmission plate, and has a transverse cross sectional shape with a primary region from which a tapered region projects, wherein each primary region and each tapered region extends through the stationary transition plate.

25. The pump as recited in claim 24 wherein each tapered region terminates at an apex.

26. The pump as recited in claim 18 wherein the throttle member includes a plurality of control apertures there through, each control aperture having a transverse cross sectional shape with a primary region from which a tapered region projects.

* * * * *